US006877631B1

(12) United States Patent
Thompson et al.

(10) Patent No.: US 6,877,631 B1
(45) Date of Patent: Apr. 12, 2005

(54) TAMPER-EVIDENT CONTAINER

(75) Inventors: David Noble Thompson, North Shields (GB); Stephen William Bushby, Bedlington (GB); Keith Stephenson, Newcastle upon Tyne (GB)

(73) Assignee: Audus Noble LTD, Blyth (GB)

( * ) Notice: Subject to any disclaimer, the term of this patent is extended or adjusted under 35 U.S.C. 154(b) by 0 days.

(21) Appl. No.: 09/959,507

(22) PCT Filed: Apr. 26, 2000

(86) PCT No.: PCT/GB00/01609

§371 (c)(1),
(2), (4) Date: Oct. 29, 2001

(87) PCT Pub. No.: WO00/66451

PCT Pub. Date: Nov. 9, 2000

(30) Foreign Application Priority Data

Apr. 30, 1999 (GB) ..... 9910143

(51) Int. Cl.[7] ..... B65D 41/32
(52) U.S. Cl. ..... 220/266; 215/249
(58) Field of Search ..... 220/266, 265, 220/324, 258.5, 276, 284; 215/243, 250, 215/253, 254, 269

(56) References Cited

U.S. PATENT DOCUMENTS 4,157,144 A * 6/1979 Weiler et al. ..... 215/252
4,478,343 A * 10/1984 Ostrowsky ..... 215/252
4,493,427 A * 1/1985 Wolkonsky ..... 215/230
4,610,371 A * 9/1986 Karkiewicz ..... 220/266
4,711,372 A * 12/1987 Gach ..... 222/23
4,883,193 A * 11/1989 Christensson ..... 220/266
5,133,470 A * 7/1992 Abrams et al. ..... 215/250
5,219,084 A * 6/1993 King ..... 215/252
5,307,949 A * 5/1994 Von Holdt, Jr. ..... 220/276

FOREIGN PATENT DOCUMENTS

GB 2239866 * 7/1991

* cited by examiner

*Primary Examiner*—Lien Ngo
(74) *Attorney, Agent, or Firm*—Stites & Harbison PLLC; Douglas E. Jackson

(57) ABSTRACT

A tamper-evident container comprises a body portion (2), a lid portion (4) adapted to engage and close said body portion (2), and at least one tamper-evident element (14) releasably attached to one of said portions (4) by a weakened connection (16), and having an operative position co-operating with means on the other of said portions (2) to prevent removal of the lid portion (4) from the body portion (2), the lid portion (4) only being removable from the body portion (2) subsequent to breakage of the weakened connection (16) between the or each tamper-evident element (14) and the one portion (4) of the container, the or each tamper evident element (14), on breakage, having a displaced position on the other portion (2) of the container providing a visual indication that tampering may have occurred, and the container incorporating means to retain the or each tamper-evident element (14) in its displaced position on the other portion (2) of the container such that removal of the or each tamper-evident element (14) from its displaced position cannot be effected without damage to the element (14).

13 Claims, 5 Drawing Sheets

TAMPER-EVIDENT CONTAINER

TECHNICAL FILED

This invention relates to tamper-evident containers and more particularly to containers provided with elements thereon for indicating whether or not the container has been tampered with prior to initial use.

BACKGROUND TO THE INVENTION

In order to attempt to counter modern trends towards sabotaging the contents of certain containers, particularly those containing materials to be consumed or to be used on babies or infants, it is becoming increasingly necessary to provide visual evidence in or on the containers that they have not been opened or tampered with prior to use of the contents.

Although tamper evident means are well-established on containers such as bottles with round lids, the provision of such means on rectangular, box-like containers comprising separate or hinged box portions and lid portions poses more of a problem.

It is known to provide sealed foil covers on the box portion below the lid portion to protect the contents of the container, but such foil seals are not visible until the lid portion is removed from the box portion.

GB 2239 866 discloses a box-like container provided with tamper evident members frangibly secured to the lid portion and co-operating with the box portion normally to prevent removal of the lid portion from the box portion. When the tamper evident members are pressed down, the frangible connection with the lid portion is broken and the lid portion can be removed from the box portion.

However, the tamper evident elements, once the frangible connections are broken, become separate from the container and must be disposed of. Clearly such disposal, particularly where there are a plurality of elements each of which must be broken away to achieve opening of the container, is inconvenient.

SUMMARY OF THE INVENTION

It would be desirable to be able to provide a container the tamper evident elements of which do not require disposal as heretofore.

According to the present invention there is provided a tamper-evident container comprising a body portion, a lid portion adapted to engage and close said body portion, and at least one tamper-evident element releasably attached to one of said portions by a weakened connection, the or each tamper-evident element having an operative position on the container co-operating with means on the other of said portions such as to prevent removal of the lid portion from the body portion, the arrangement being such that the lid portion can only be removed from the body portion subsequent to breakage of the weakened connection between the or each tamper-evident element and the one portion of the container, characterised in that the or each tamper evident element, on breakage, has a displaced position on the other portion of the container providing a visual indication that tampering may have occurred, the container incorporating means to retain the or each tamper-evident element in its displaced position on the other portion of the container such that removal of the or each tamper-evident element from its displaced position cannot be effected without damage to the element, thereby making it difficult or impossible to hide the fact that the tamper-evident elements have been disturbed.

In one embodiment of the invention the respective portions of the container have co-operating rims on part or the whole of their co-operating peripheries. The tamper-evident elements may be incorporated in these rims, preferably in the lid portion.

Conveniently the rim of the body portion is of substantially inverted U-shape in transverse section and includes, for the or each tamper-evident element, an aperture in the upper wall thereof, said element, in its operative position, projecting from said aperture above the upper wall of the rim of the body portion, breakage of the or each weakened connection being achieved by forcible depression of the or each tamper-evident element into a displaced position, in which displaced position the or each element is housed within the rim of the body portion with the upper wall of the tamper-evident element being substantially co-planar with the upper wall of the rim of the body portion to be visible through the associated aperture in said rim of the body portion.

In an alternative embodiment of the invention, the container comprises a body portion having a reduced diameter neck, and a lid portion which is a push snap-fit onto the neck of the body portion, the or each tamper-evident element being connected by a weakened connection to the lower edge of the lid portion to depend therefrom, the neck of the body portion having formed thereon, one for each tamper-evident element, a hollow box-like receiving member into which the associated tamper-evident element extends to be contained thereby in the operative position of said element, the or each tamper-evident element and the or each receiving member having co-operating surfaces thereon preventing relative axial movement between the lid portion and the body portion, the arrangement being such that, on forcible removal of the lid portion from the body portion, the or each weakened connection is broken and the or each tamper-evident element falls to a displaced position projecting from the associated receiving member to provide a visual indication of said removal.

Conveniently the displaced position of a tamper-evident element within the receiving member is determined by abutment of the lower end of the element with a shoulder on the body portion below the neck thereof.

Preferably the or reach tamper-evident element is integrally moulded with its associated container portion and is connected thereto by means of at least one strip member extending between said element and said portion, the connection between the strip member and the container portion being weaker than the connection between the strip member and the element.

DETAILED DESCRIPTION OF THE PREFERRED EMBODIMENTS

Figure 1:
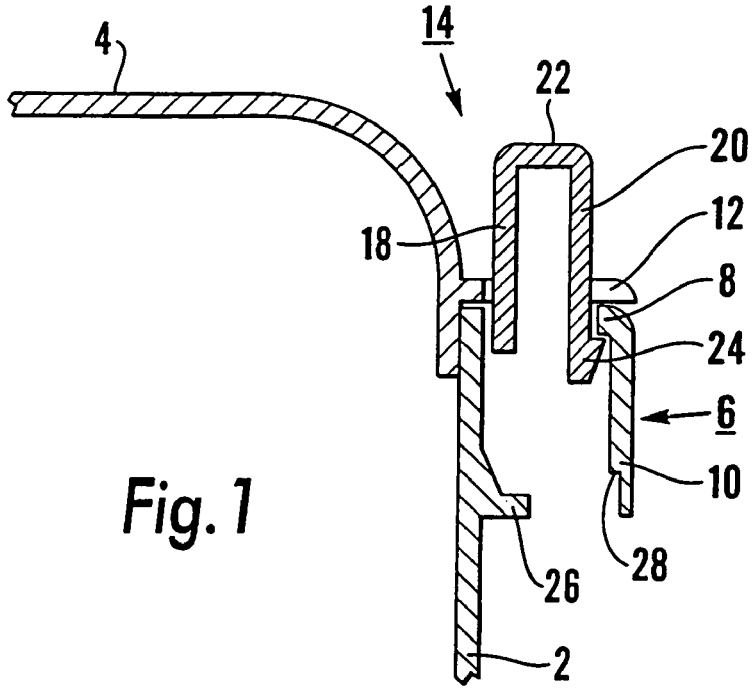
FIGS. 1 and 2 are scrap vertical sections through part of the lid portion, body portion and tamper-evident element of a first container according to the invention in the operative position and displaced position respectively of the tamper-evident element.

Referring to FIGS. 1 to 5 of the drawings, the illustrated first container comprises a box portion 2 to which is hingedly mounted a lid portion 4. The box portion 2 is provided with a peripheral rim 6 of substantially inverted U-shape in transverse section, said rim 6 including a substantially horizontal top wall 8 and a depending outer sidewall 10.

The lid portion 4 includes a substantially horizontal peripheral rim 12, the rims 6 and 12 being integrally moulded with the associated portion 2,4 of the container.

Integrally moulded with the rim 12, one to each side of the container, are a pair of tamper-evident elements indicated generally at 14, each element 14 being substantially U-shape in transverse section. The elements 14 are each connected to the rim 12 by a number of tapering strips 16 integrally moulded with the rim 12 and the element 14 and extending between the element 14 and the rim 12, the area of connection between each strip 16 and the rim 12 being substantially less than that between the strip 16 and the element 14.

Figure 3:
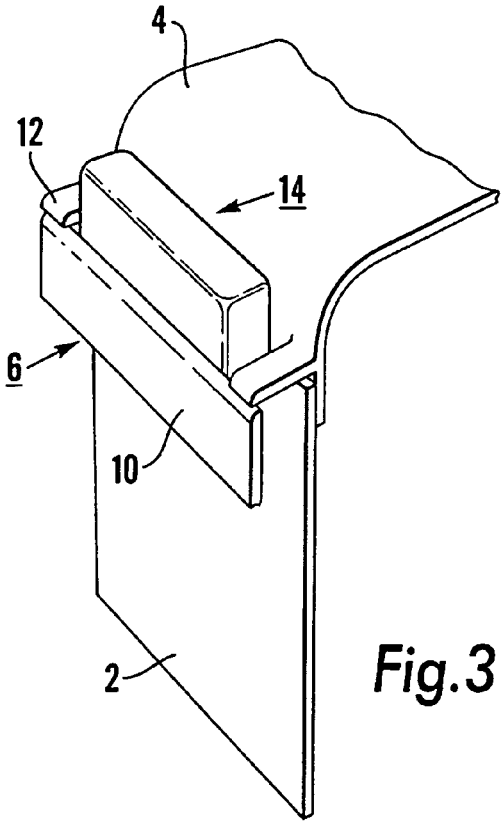
FIGS. 3 and 4 are isometric views of the parts of the container shown in FIGS. 1 and 2 respectively.

The elements 14 each comprise opposed sidewalls 18, 20 and a top wall 22 and, in the operative position of an element 14 shown in FIGS. 1, 3 and 6, the bulk of the element is upstanding from the rim 12 of the lid portion 4, only the free ends of the sidewalls 18, 20 depending below the plane of the rim 12. The free end of the sidewall 20 is provided with an outwardly-projecting flange 24 thereon for reasons which will become apparent.

The rim 6 of the box portion 2 is provided with a pair of apertures in the top wall 8 thereof, one located below each of the elements 14 on the lid portion 4, and said apertures being shaped to receive therein the lower regions of the elements 14 in their operative positions.

More particularly, on closure of the container and with the elements 14 in their operative positions, sidewalls 18, 20 of the elements 14 pass through the associated apertures in the rim 6, the flange 24 on the sidewall 20 snapping under the defining edge of the aperture in the top wall 8 of the rim 6, as seen in FIG. 1, to lock the lid portion 4 to the box portion 2 and to prevent opening of the container.

Thus the upstanding positions of the elements 14 indicate the factory-produced, normally closed position of the container prior to initial opening thereof.

Figure 2:
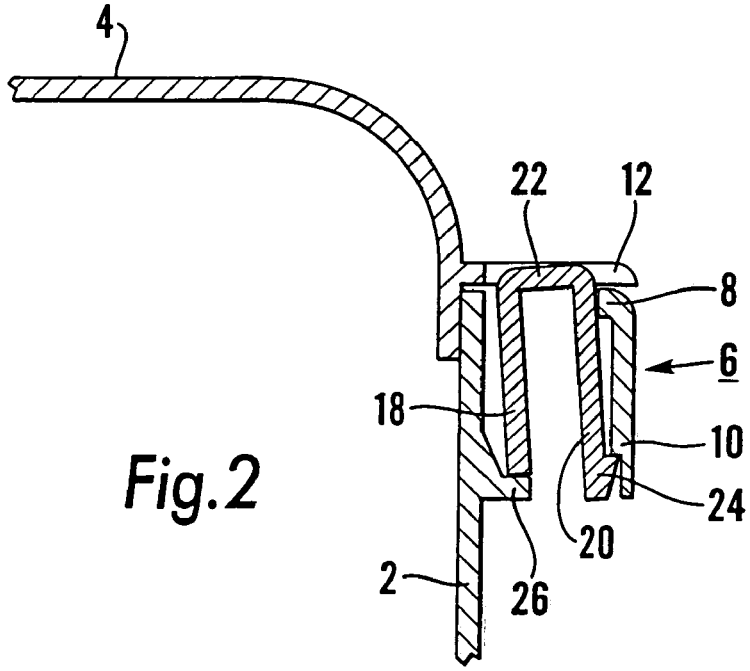
Figure 4:
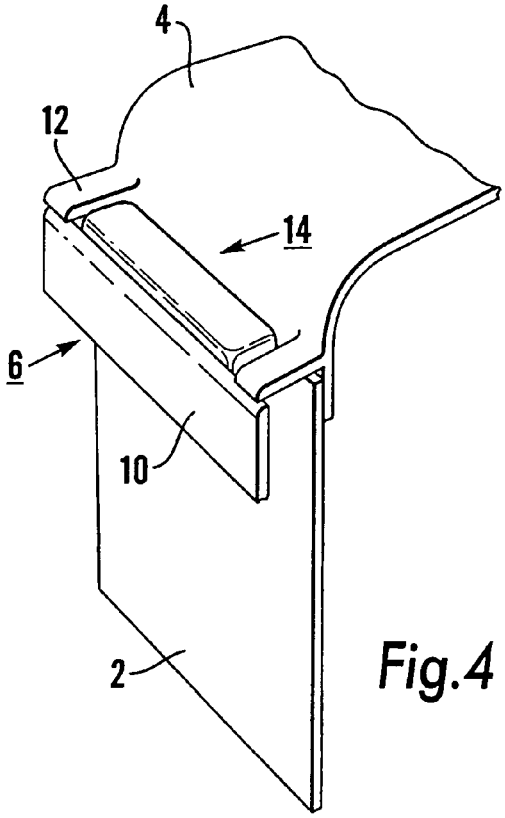
Figure 5:
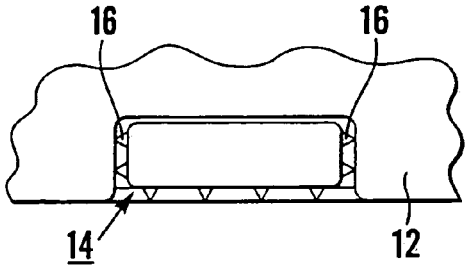
FIG. 5 is a plan view from above of a tamper-evident element of the container of FIGS. 1 and 2 showing the means of connection to the rim of the lid portion.

In order to open the container, the elements 14 are each pressed downwardly relative to the rim 12 of the lid portion 4 whereby the weakened connection between the strips 16 and the rim 12 are broken and the elements 14, together with the strips 16 integral therewith, are each displaced bodily downwardly into the position shown in FIGS. 2 and 4 housed within the rim 6 of the box portion 2.

The internal configuration of the rim 6 is such as to provide an abutment 26 for the free end of the sidewall 18 of the element 14 and a co-operating undercut shoulder 28 for engagement by the flange 24 on the sidewall 20 of the element 14, whereby the element 14 is positively retained in its displaced position within the rim 6 with the upper surface of the top wall 22 of the element 14 lying substantially co-planar with the upper surface of the rim 12 of the lid portion—the co-operation between the flange 24 and the shoulder 28 prevents return of the element 14 from its displaced position towards its operative position.

Thus it will be appreciated that the positions of the elements 14 give a visual indication of the condition of the container, a supposedly unopened container in which the elements 14 are in their displaced positions indicating it has possibly been tampered with. Furthermore, the retention of the elements 14 in their displaced positions eliminates the necessity to dispose of the elements once the container is legally opened for normal use.

Clearly the precise number, location and configuration of the tamper-evident elements 14 can be varied to suit particular requirements providing there is a weakened connection between each element 14 and the rim 12 of the lid portion to enable displacement of the element from its operative position locking the container to a retained position permitting opening of the container and providing visual evidence of the condition of the container.

The container may comprise a detachable lid that is removable to open the container, or may have a captive lid, retained for example by separate or integral hinge means.

Figure 6:
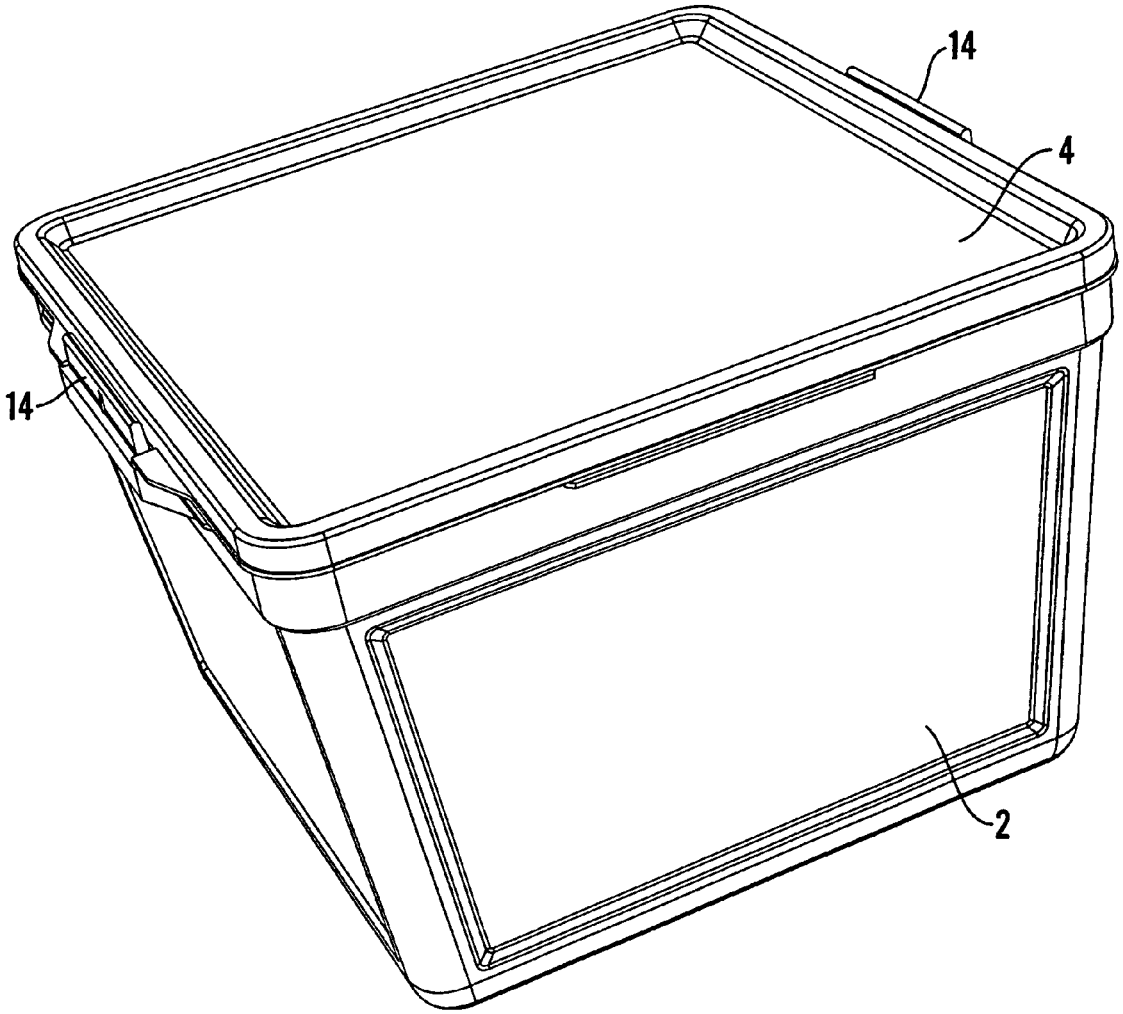
FIG. 6 is an isometric view of a closed second container according to the invention.

FIG. 6 shown a box-like container according to the invention in its closed condition and in which the lid portion 4 is retained on the box portion 2 thereof by an opposed pair of tamper evident elements 14 carried by the lid portion 4, one to each end of the container, and depending through associated apertures in the rim of the box portion 2 substantially as detailed above with reference to FIGS. 1 to 5.

Figure 7:
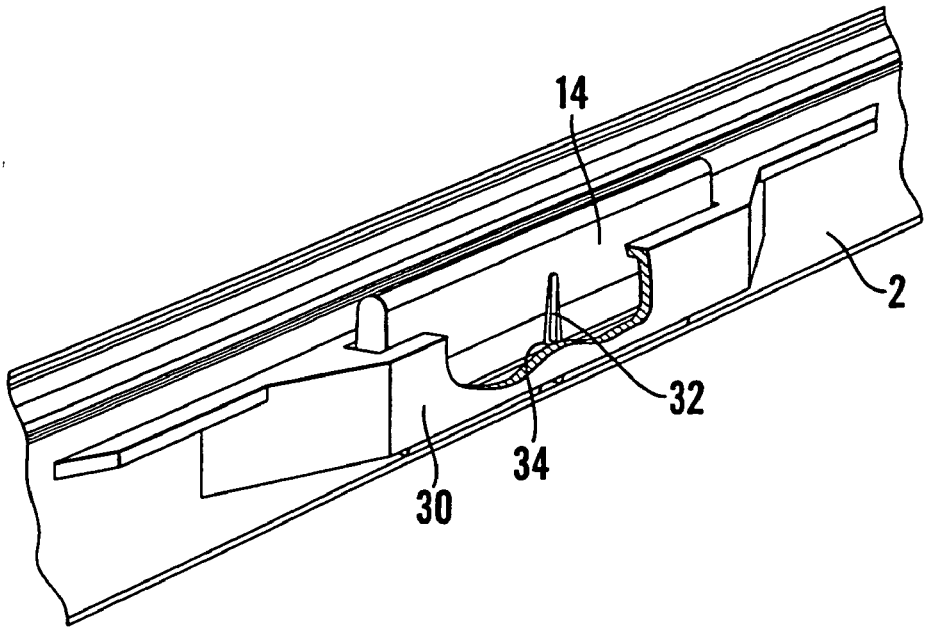
FIG. 7 is an isometric view, partly cut away, of the tamper evident element of the container of FIG. 6 with the lid portion removed.

However, the means for retaining an element 14 in its displaced position differ from those of the container of FIGS. 1 to 5 as can be seen from FIG. 7.

Referring to FIG. 7, the box portion 2 includes a rim in the form of a box—like receiving sleeve 30 integrally moulded with each opposed side wall of the portion 2 and adapted to receive the tamper evident element 14 in its displaced position. A vertical rib 32 extends between the wall of the sleeve 30 and the wall of the box portion 2, the tamper evident element 14 having an upwardly tapering vertical groove 34 formed centrally therein.

The displaced position of the tamper evident element 14 is determined by co-operation between the rib 32 and the groove 34 as can be seen in FIG. 7, this cooperation retaining the tamper evident element 14 in its displaced position in which the top thereof is visible above the sleeve 30.

Figure 9:
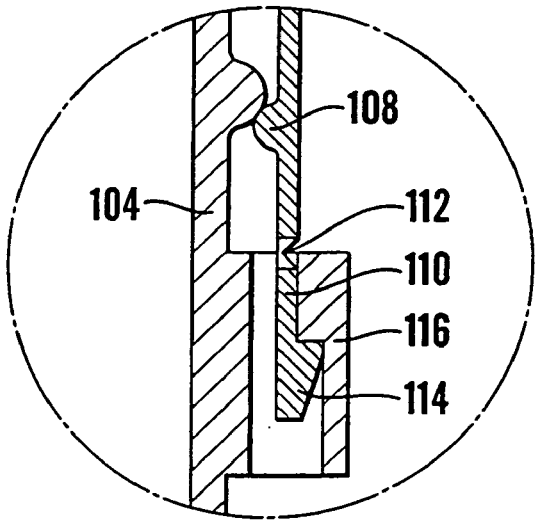
FIG. 9 is a detail of FIG. 8.
Figure 8:
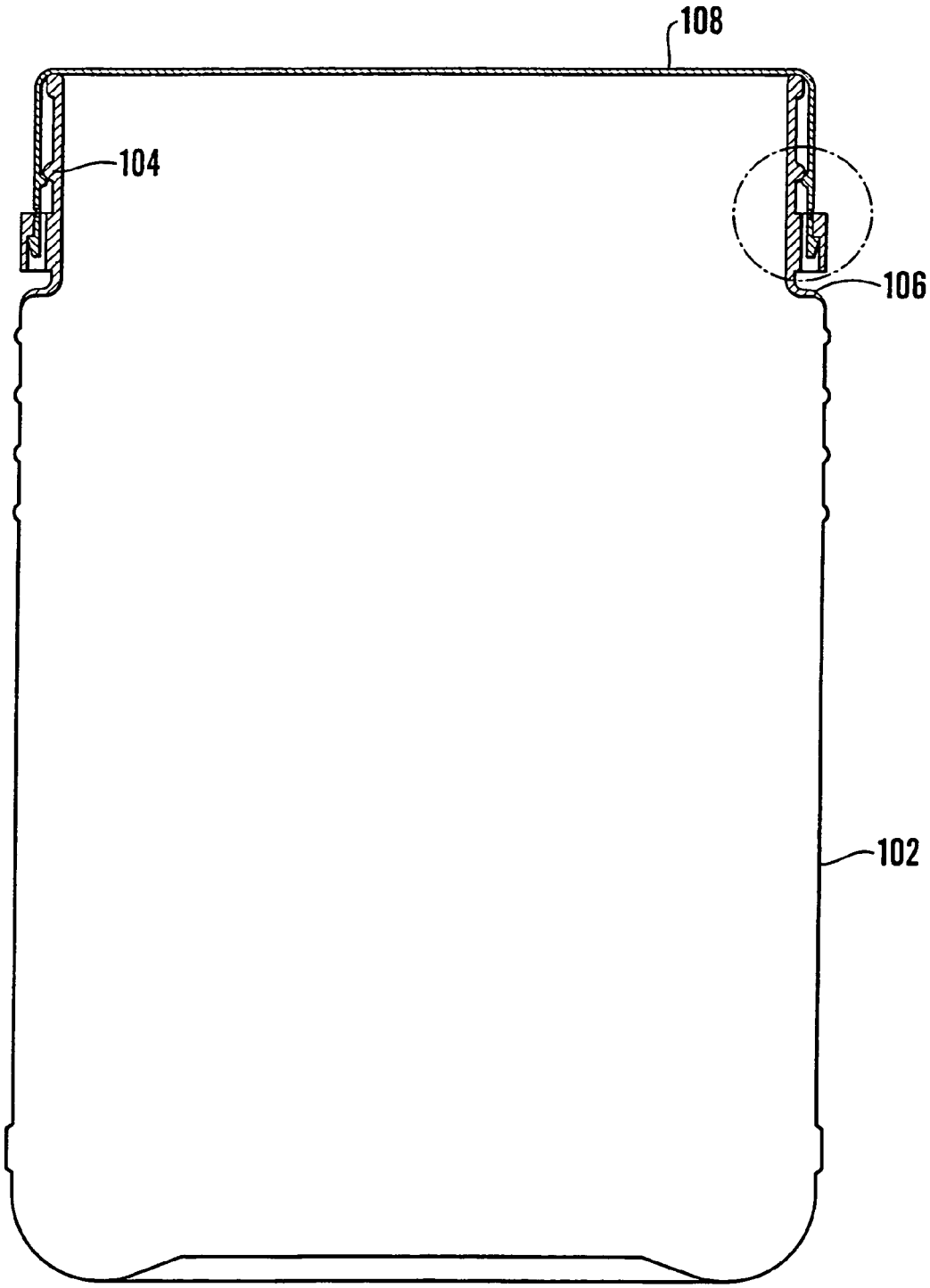
FIG. 8 is a vertical section through a third container according to the invention.

Referring to FIGS. 8 and 9 of the drawings there is shown an alternative container according to the invention comprising a rectangular section body portion 102 having a reduced dimensional neck 104 above a defining shoulder 106 on the body portion. The container is completed by a lid portion 108 which is a push snap fit on the neck 104.

A pair of diametrically-opposed tamper-evident elements in the form of clips 110 depend from the rim of the lid portion 108, each clip 110 being connected to the lid portion by a series of thin tabs 112. Each clip 110 is formed at its free end with an outwardly facing hook portion 114 having a horizontal surface thereto.

A corresponding pair of hollow, box-like housings 116 are integrally moulded on the external surface of the neck 104, each adapted to receive therein an associated one of the clips 110.

The internal face of the outer wall of each housing 116 is formed with an undercut having a horizontal surface thereto, the arrangement being such that, with the lid portion 108 of the container positioned on the neck 104 of the body portion 102, the clips 110 are received within associated housings 116 and the horizontal surfaces of the clips 110 and the housings 116 co-operate with one another to prevent removal of the lid portion 108 from the body portion 102.

Opening of the container is achieved by forcible upward movement of the lid portion 108 whereby the tabs 112 are broken to release the lid portion 108 from the neck 104, the clips 110 remaining within their associated housings 116 because of the co-operation between the horizontal surfaces thereon.

Subsequent to breakage of the tabs 112, the clips 110 each fall under gravity to a position determined by abutment of the lower end of the hook portion 114 with the shoulder 106, in which position the stem of a clip 110 remains within the associated housing 116 but the hook portion 114 projects therefrom to provide a visible indication that the lid portion 108 has been removed from the body portion 102.

Clearly the precise construction of the container of FIGS. 8 and 9 can be varied from that described and illustrated. In particular the number and locations of the clips 110 and housings 116 can be varied to suit particular requirements, as can the particular construction of the clips 110 and housings 116 and the locking means preventing removal of the clips 110 from the housings 116.

What is claimed is:

1. A tamper-evident container comprising a body portion having a top, a bottom, a longitudinal axis extending between the top and bottom, and a side wall or walls extending longitudinally between the top and bottom and located laterally around the longitudinal axis, a lid portion adapted to engage said body portion in order to close the top, at least one tamper-evident element which is located laterally outward of the longitudinal axis from the adjacent side wall or walls, a weakened connection which releasably attaches said tamper-evident element to a part of said lid portion and which is located laterally outward of the longitudinal axis from the adjacent side wall or walls, a removal prevention means, which is provided on a part of said body portion and which is located laterally outward of the longitudinal axis from the adjacent side wall or walls, for preventing removal of the lid portion from the body portion when said tamper-evident element is in an operative position, such that the lid portion can only be removed from the body portion subsequent to breakage of the weakened connection between the tamper-evident element and the lid portion, and a retaining means to retain the tamper-evident element on the body portion, said retaining means being located laterally outward of the longitudinal axis from an adjacent side wall or walls such that the tamper evident element, after breakage of the weakened connection, has a displaced position on the part of the body portion which provides an easy view thereof and hence a ready visual indication that tampering may have occurred, and such that removal of the tamper-evident element from the displaced position thereof on the body portion cannot be effected without evident damage; and wherein the body and lid portions have co-operating rims on part or a whole of co-operating peripheries thereof;

wherein the rim of the body portion is of substantially inverted U-shape in transverse section and includes, for the tamper-evident element, an aperture in an upper wall thereof, said tamper-evident element, in its operative position, projecting from said aperture above the upper wall of the rim of the body portion, breakage of the weakened connection being achieved by forcible depression of the tamper-evident element into the displaced position; and wherein the tamper-evident element in the displaced position is housed within the rim of the body portion with an upper wall of the tamper-evident element being substantially co-planar with the upper wall of the rim of the body portion such that the upper wall of the tamper-evident element is visible through the aperture in said rim of the body portion.

2. A tamper evident container as claimed in claim 1, in which the tamper-evident element is incorporated in the cooperating rims.

3. A tamper-evident container as claimed in claim 1, in which the retaining means comprises an abutment projecting outwardly from the body portion within the rim thereof.

4. A tamper-evident container as claimed in claim 1, in which the rim of the body portion is provided with a locking means to prevent upward movement of the tamper-evident element from the displaced position thereof.

5. A tamper-evident container as claimed in claim 1, in which the retaining means comprises a rib within the rim of the body portion adapted to receive thereon, and locate, the temper-evident element in the displaced position thereof.

6. A tamper-evident container as claimed in claim 1, wherein said body portion includes a reduced diameter neck, wherein said lid portion is an axial push snap-fit onto the neck of the body portion, wherein the tamper-evident element is connected by the weakened connection to a lower edge of the lid portion to depend therefrom, wherein the neck of the body portion has formed thereon, for the tamper-evident element, a hollow receiving member into which the tamper-evident element extends to be contained thereby in the operative position of said tamper-evident element, wherein the tamper-evident element and the receiving member have respective surfaces thereon co-operating to prevent relative axial movement between the lid portion and the body portion, such that, on forcible removal of the lid portion from the body portion, the weakened connection is broken and the tamper-evident element falls to the displaced position where a portion of the tamper-evident element projects beyond the receiving member to provide a visual indication of said removal.

7. A tamper-evident container as claimed in claim 6, in which the displaced position of said tamper-evident element within the receiving member is determined by abutment of a lower end of the tamper-evident element with a shoulder on the body portion below the neck.

8. A tamper-evident container as claimed in claim 1, wherein the tamper-evident element is integrally molded with the lid portion and wherein the weakened connection is at least one strip member extending between said tamper-evident element and said lid portion, such that a strength of connection between the strip member and the lid portion is weaker than a strength of connection between the strip member and the tamper-evident element.

9. A tamper evident container as claimed in claim 2, in which the tamper-evident element is incorporated in the lid portion.

10. A tamper-evident container comprising a body portion, a lid portion adapted to engage and close said body portion, at least one tamper-evident element, a weakened connection which releasably attaches said tamper-evident element to said lid portion, a removal prevention means provided on said body portion for preventing removal of the lid portion from the body portion when said tamper-evident element is in an operative position, such that the lid portion can only be removed from the body portion subsequent to breakage of the weakened connection between the tamper-evident element and the lid portion, and a retaining means to retain the tamper-evident element on the body portion such that the tamper evident element, on breakage, has a displaced position on the body portion providing a visual indication that tampering may have occurred, and such that removal of the tamper-evident element from the displaced position thereof on the body portion cannot be effected without evident damage;

wherein the body and lid portions have co-operating rims on part or a whole of co-operating peripheries thereof;

wherein the rim of the body portion is of substantially inverted U-shape in transverse section and includes, for the tamper-evident element, an aperture in an upper wall thereof, said tamper-evident element, in its operative position, projecting from said aperture above the upper wall of the rim of the body portion, breakage of the weakened connection being achieved by forcible depression of the tamper-evident element into the displaced position; and wherein the tamper-evident element in the displaced position is housed within the rim of the body portion with an upper wall of the tamper-evident element being substantially co-planar with the upper wall of the rim of the body portion such that the upper wall of the tamper-evident element is visible through the aperture in said rim of the body portion.

11. A tamper-evident container as claimed in claim 10, wherein the retaining means comprises an abutment projecting outwardly from the body portion within the rim thereof.

12. A tamper-evident container as claimed in claim 10, wherein the rim of the body portion is provided with a locking means to prevent upward movement of the tamper-evident element from the displaced position thereof.

13. A tamper-evident container as claimed in claim 10, wherein the retaining means comprises a rib within the rim of the body portion adapted to receive thereon, and locate, the tamper-evident element in the displaced position thereof.

* * * * *